US006656009B1

(12) United States Patent
Epping

(10) Patent No.: US 6,656,009 B1
(45) Date of Patent: Dec. 2, 2003

(54) DOLL LOUNGER

(76) Inventor: Astrid Epping, Waldstrasse 3, Wohltorf (DE), 21521

( * ) Notice: Subject to any disclaimer, the term of this patent is extended or adjusted under 35 U.S.C. 154(b) by 0 days.

(21) Appl. No.: 09/648,032

(22) Filed: Aug. 25, 2000

(30) Foreign Application Priority Data

Feb. 22, 2000 (DE) ..... 200 03 147 U

(51) Int. Cl.[7] ..... A63H 3/00
(52) U.S. Cl. ..... 446/268; 446/482
(58) Field of Search ..... 446/482, 227, 446/491, 73, 71, 74, 479, 268; 5/655, 101, 103, 120, 122, 123; 297/DIG. 2, 273, 281; D21/123

(56) References Cited

U.S. PATENT DOCUMENTS

D143,283 S * 12/1945 Pirro
D291,102 S * 7/1987 Marshall ..... D21/121
4,717,056 A * 1/1988 Carmichael ..... 224/158
4,980,937 A * 1/1991 Mason et al. ..... 5/431
5,097,545 A * 3/1992 Hooi ..... 5/104
5,127,120 A * 7/1992 Mason ..... 5/655
5,333,769 A * 8/1994 Skroski ..... 224/158
5,551,109 A * 9/1996 Tingley et al. ..... 5/655
5,573,156 A * 11/1996 McConnell ..... 224/158
D407,213 S * 3/1999 McConnell ..... D3/213
5,964,506 A * 10/1999 Coates et al. ..... 297/484
5,988,743 A * 11/1999 Drexler ..... 297/250.1
6,213,362 B1 * 4/2001 Lorenzini et al. ..... 224/158

FOREIGN PATENT DOCUMENTS

CA 2048839 * 2/1993
DE 20114789 * 11/2001

* cited by examiner

*Primary Examiner*—Jacob K. Ackun
*Assistant Examiner*—Jamila Williams
(74) *Attorney, Agent, or Firm*—Townsend and Townsend and Crew LLP

(57) ABSTRACT

A lounger, bed, cradle, swing or the like for dolls or infants. The lounger includes a basic body, a casing therefor and a structure for correctly positioning the lounger when in use. The basic body has a shell-like design and is made of a soft foam material. The basic body has a substantially hollow ellipsoid shape. Thus, the basic body is rounded underneath on all sides and has an elliptical-shaped rim with two somewhat elongated long sides and rounded end sections.

35 Claims, 5 Drawing Sheets

DOLL LOUNGER

BACKGROUND OF THE INVENTION

The present invention relates to a doll lounger and a basic body for the manufacture thereof.

The subject matter of the present invention is designated a doll lounger and the use thereof is described below in conjunction with dolls. However, it is equally useful, particularly in a somewhat larger version, as a lounger for infants. Thus, the utility of the subject matter of the present invention should not be limited by the choice of terminology. Even when used for dolls the present invention could equally be referred to as a doll bed, a doll cradle or a doll swing. The concept of doll lounger is chosen as a cover term that includes the aforementioned designations.

As to their basic structure, known doll beds, cradles, as well as doll prams are generally made of a hard or stiff material, such as metal, wood or hard plastic. In general, they are designed to be stored on the floor or on some other hard underlying surface. There are also carrier pouches for dolls which are made of a flexible, foldable material, but which also have rigid frame components for providing form stability. Carrier pouches such as these are also designed to be stored on a hard underlying surface when they are not being moved.

Due to those components made of stiff material, items of this type are cumbersome and thus not easy to store in closets or to stow away on trips. When unable to be stored, these items take up storage space, whether on the room floor or on top of chests. Moreover, hard objects may cause injury to children.

SUMMARY OF THE INVENTION

Thus, the object of the present invention is to manufacture a doll lounger that is flexible in its handling, is attractively designed and, for purposes of storage, can be reduced to a volume that is smaller than that when in use.

The object is achieved in principle by a doll lounger comprising a basic body, a casing therefor and means for correctly positioning said lounger when in use, in which the basic body has a shell-like design and is made of a soft foam material.

In a preferred embodiment of the invention the shell-like design of the soft foam basic body is more specifically characterized by a substantially hollow ellipsoid shape or, expressed in simpler terms, is shaped somewhat like an elongated walnut shell half. Thus, the basic body is rounded underneath on all sides and has an elliptical-shaped rim with two somewhat elongated long sides and rounded end sections. This description is intended only as an approximate characterization of the basic body. Even the preferred embodiment may deviate from the exact recitation given above. The wording of the description of the shell-shaped basic body is to be broadly interpreted. In an especially advantageous embodiment, the rim contour of the shell-shaped basic body is not necessarily oriented in a plane. Rather, the rim contour of the basic body may slope upwardly; that is, the contour of the long sides is slightly concave as viewed in vertical extension from above, whereas the rounded end sections are slightly convex in shape. Strictly speaking, at least one of the end sections in which the head of the doll rests is slightly higher than the long sides. For reasons of aesthetics, it is preferable if both end sections are somewhat higher, though such a characterization is relative, since in view of the rounded underside of the basic body, no specific horizontal position is indicated.

To achieve lasting form stability, the final shape of the basic body is foam-molded, preferably from a soft polyurethane foam. It would be difficult and costly to make the basic body from a foam block, not the least of which is the high level of material waste involved. To fashion a basic body from a foam plate would also be unsuitable. In particular, it is impossible to achieve lasting form stability given the tendency of a plate to invariably resume its flat orientation.

When referring to a soft foam material, what is meant is a type of material that can easily be squeezed together or deformed when a specific force is applied to it, but which resumes its original shape in the absence of such force. This involves foams of the type used in mattresses or padding inserts. They have a resiliency that invariably enables them, once deformed, to return to their original shape.

The basic body of the doll lounger described herein must be resilient enough to substantially maintain its original shape, even when exposed to stresses resulting from the kind of use for which it was intended. As described hereinafter, the doll lounger according to the present invention is primarily designed to be suspended. Thus, the basic body must have sufficient form stability to prevent it from becoming unduly deformed when subject to the load of a doll, bed clothes and the like, and when suspended from several points along its rim.

Those skilled in the art are familiar with foamed plastic as a possible choice for the use set forth above. Where there is doubt with regard to a given foam material, the thickness of the shell-shaped basic body should be selected so that it meets the aforementioned form stability requirements. The soft foam material preferably selected for the basic body has a density in the range of 70 g/dm$^3$ and a hardness of approximately 1.2 Shore A.

The doll lounger may have walls of the basic body with a thickness in a range of 20 mm to 40 mm. This thickness would be indicated for a basic body that is approximately 300 mm to 500 mm long and approximately 200 mm to 300 mm wide. The overall height of the basic body is approximately 150 mm to 220 mm. By way of example, given a standard polyurethane foam, a shell thickness of 25 mm to 30 mm would be indicated for a basic body that is approximately 450 mm long and approximately 250 mm wide, measured over the long and short axes, respectively, of the elliptical-shaped rim to the outer edges thereof. The aforementioned dimensions apply to a lounger for an average-sized baby doll.

The casing for the basic foam body may consist of any flat, flexible material that is adaptable to the exterior shape of the basic body. Even a coating permanently applied to the basic body having protective and decorative features, or gluing a decoratively shaped film or the like thereto, would be conceivable. In a preferred embodiment of the invention, however, the casing of the doll lounger consists of a cover made of a textile fabric or fleece. These materials offer a wide range in exterior décor. In particular, since exterior décor can be crucial for the aesthetic appeal of the doll lounger, an outer covering is provided which conforms substantially to the convex outer surface of the basic body and which extends on the outside to the elliptical-shaped rim of said body. Appropriately, such an outer covering has a finished edge of general design, preferably in the form of piping, a strip or the like extending along the rim of the basic body.

As indicated above, means for correctly positioning the lounger are provided primarily in the form of suspension means, since in a preferred embodiment the lounger has on level undersurface on which it can be placed. Such means are comprised preferably of four suspension lines that are fastened, or can be fastened, in pairs spaced apart from one another on the sides of the body rim. Such lines are preferably textile cords, ties or the like. They are appropriately bunched together near a selected suspension point, thus creating a single suspension point to enable the lounger to swing.

In principle, the means for suspending the lounger are attached or are attachable to the basic body. In an especially preferred embodiment of the invention, however, the suspension means are connected to the outer covering or the finished edge thereof. Thus, the outer covering functions as a type of carrying case for the basic body and/or for the entire lounger. The advantages of this from a technical and manufacturing standpoint are considerable, since it is no longer necessary to mount any type of connecting means to the foam body itself. It simply rests, as finished, in its outer covering. This type of suspension is also advantageous, especially if the suspension lines are attached to a finished edge of the outer covering that is designed, for example, as a thick cord. This is because the suspension forces are more effectively distributed over the entire circumference of said finished edge, thereby preventing any extreme, local deformation of the foam body.

The suspension lines may be attached to the edge of the outer covering or to the finished edge thereof in any of several ways. It may be aesthetically appealing if the finished edge and the suspension lines are made of the same textile cord. For example, such a textile cord may be stitched or otherwise fastened as a finished edge to the entire edge of the outer covering, it may be connected to the edge of the outer covering at spaced intervals to allow for open gaps in which the suspension line can be passed around the finished cord, or it can also be connected in loops along the edge of the outer covering. In the first instance, rings can be mounted at suspension points on the finished cord to which the suspension cords are then attached, e.g. knotted. In the second and third instances, it would be feasible in those spaces in which the finished cord is not attached to the edge of the outer covering to pass the suspension lines around the outer cord and knot them. Passing the outer cord in loops along the edge of the outer covering is advantageous in that the cord may then be cinched tightly about the basic foam body.

Thus far, reference has been made to a cover only in the form of an outer covering. It is preferable, however, to also cover at least a portion of the inner surface of the basic body. Such a covering is referred to here as a base cover, since in addition to the inner surface of the foam body, it may, in one type of embodiment, cover the outer surface of the basic body as well. In its simplest form the base cover may be a type of apron attached to the edge of the outer covering or also to the finished edge of the outer covering, and which hangs a certain distance down into the interior space of the shell-shaped basic body. In this embodiment it is not essential that the base cover blanket the whole interior bottom of the basic body, since doll bedding is also arranged therein. Thus, for aesthetic reasons, only the inside rim of the basic body is covered. In this embodiment, the basic body and the covering are easily separated from one another for purposes of separate cleaning. A more elaborate embodiment is comprised of a base cover that lines the whole interior surface of the basic body. In this embodiment as well, said base cover is expediently attached to the edge of the outer covering or to the finished edge thereof. In this type of embodiment it is necessary to ensure proper assembly, namely, fitting of the basic body completely inside the entire covering. This may be accomplished, for example, by keeping a portion of the seam open between the outer covering and the base cover into which the basic body is inserted, and which is then closed. It is also possible, for example, to incorporate a zipper, a Velcro-fastener or the like in the base cover or on the edge thereof on the inside of the basic body, and which allows removal of the entire covering from the basic body, e.g. to be washed.

In yet another embodiment the base cover covers the entire basic body, both inside and outside. To remove the basic body therefrom, means such as those described above may be provided. In this embodiment the outer covering is provided as a second cover over the outside of the lounger. It functions, as previously described, solely as a "carrying pouch" for the basic body which is completely wrapped in the base cover, and it serves an aesthetically designed exterior. With regard to this latter purpose in particular, it is possible to adapt the outer covering to the outer surface of the basic body by employing sewing steps, e.g. pleating or fastening of folds, to thereby lend it a specific exterior design. It is also possible, for example, to fold the outer covering inside out at the finished edge, lending a flounce to said covering.

For purposes of aesthetic design, it is also possible to make the base cover and the outer cover from different types of material. The outer covering may be made, for example, of materials which have a desirable decorative pattern.

The design of the doll lounger according to the present invention described above also offers the immediate option of fitting the lounger with additional utilitarian or decorative elements in harmonious fashion. Thus, the downwardly-rounded shell shape may be interrupted by further extending the suspension lines downwardly from their points of attachment on the finished edge of the outer covering, and by hanging decorative elements thereon. Further, a finished edge that is not fastened around the entire edge of the outer covering also offers the option of mounting, e.g. hooking on, doll toys or other similar objects.

To the extent that means for suspending the doll lounger according to the present invention are not always available, the invention is completed by providing it in a supplemental embodiment with an understructure. The basic body of the lounger is shaped like a rounded elliptical shell; thus, it is expedient if the understructure has a support frame that conforms to the elliptical shape of the basic body and which has dimensions identical to the cross-section of the basic body at about medium height. This allows the lounger to be placed in the support frame along an elliptical-shaped line of contact. The understructure may be provided with feet only, or it can have rocker members. Further, as with a doll pram, it may be fitted with wheels and a handle for pushing. In all embodiments it is also possible to mount a bracket-like suspension arm to which a "sky"can be attached. Finally, a bracket-like stand may also be provided on which the lounger is suspended, if no means of suspension are available on the room ceiling, door frame or on a branch outdoors.

As the aforementioned embodiments show, the doll lounger described herein is versatile. Because of its suspension capability, it may be set to any desirable position that is adaptable to the height of the child playing with it. Only soft materials are used, hence, there is virtually no possibility of injury when the child bumps against the lounger. Moreover, the lounger yields merely by virtue of its pendulum-like suspension capability. Aside from the embodiment that includes an understructure, the lounger is deformable due to its soft foam basic body, and is thus easy to stow and to pack inside luggage. When traveling, it may also be squeezed into an empty corner of the trunk. Places to hang the lounger are always available, even a hook on the rim of a door frame. The suspension lines are variable such that the lounger is mountable at suspension points of varying height that are appropriate to the child. Of particular advantage given its simple construction are the aesthetic design possibilities. Various coverings may be provided, for example, that may be used in conjunction with the same basic body type. The child playing with it thus has alternative possibilities. The covering, which may be easily removed from the basic body, is also easy to clean.

Finally, the design of the lounger is simple and this results in cost-effective methods of manufacture. The basic body is foam-finished. Additional production steps are not required. The coverings are easy to make using textile manufacturing processes.

Many of the aforementioned advantages also apply to its use as a baby lounger.

The present invention is described in greater detail below with reference to the embodiments shown in FIGS. 1–3.

DETAILED DESCRIPTION OF SPECIFIC EXEMPLARY EMBODIMENTS

Figure 1A:
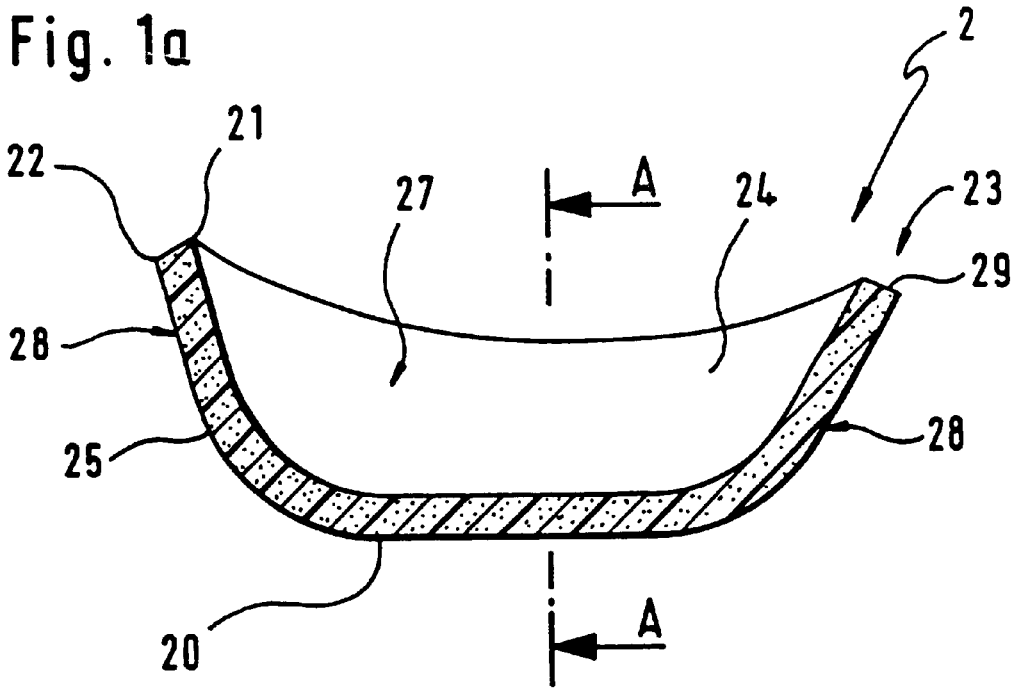
FIG. 1*a* is a longitudinal cross-section of a basic body for a doll lounger.

FIG. 1*a* shows a longitudinal cross-section through a basic body 2 for a doll lounger. Basic body 2 was molded from a soft polyurethane foam plastic having a density of 70 g/l and a hardness of 1.2 Shore A.

Figure 1B:
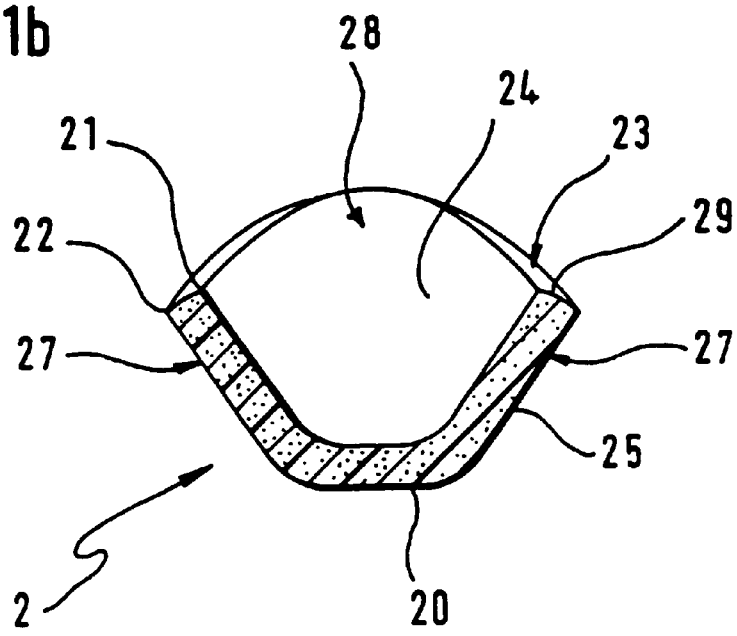
FIG. 1*b* is a cross-sectional view perpendicular to the longitudinal direction through a basic body for a doll lounger.

FIG. 1*b* shows a cross-section through the molded body 2 of FIG. 1 perpendicular to its longitudinal direction and along lines A—A. When viewed together, FIGS. 1*a* and 1*b* show that basic body 2 is designed in the shape of a shell and resembles substantially a hollow semi-ellipsoid. Basic body 2 has a concave inner surface 24 and a convex outer surface 25. Both surfaces 24 and 25 correspond approximately to the surface section of an ellipsoid. Inner surface 24 and outer surface 25, respectively, terminate at an inner edge 21 and an outer edge 22. Inner edge 21, outer edge 22 and the surface 29 therebetween form an ellipsoid-shaped rim, in which surface 29 is angled outwardly in a slightly downward direction.

The dimensions chosen are those of an average-sized doll. The long sides 27 are a maximum of 45 cm in length, that is, from outer edge 22 to outer edge 22. The short sides 28 are a maximum of 25 cm in length, that is, from outer edge 22 to outer edge 22. The rim 23 is 2.5 cm wide, which corresponds to the foam thickness of the entire basic body 2. This thickness ensures both adequate form stability as well as plasticity.

The basic body 2 is formed higher at one of the ends 28 than at the other to indicate which end is the head of the doll lounger. Between the two ends 38, rim 32 exhibits a slightly concave course. The elevated end 28 is 17 cm high from base to inner edge 21; the other end 28 is 15.5 cm high from base to inner edge 21. The long sides 27 are 12 cm high at the lowest point, approximately midway between the two ends 28. The ellipsoid shape of the outer surface 25 results in an underside 20 that is rounded off in all directions.

Figure 2:
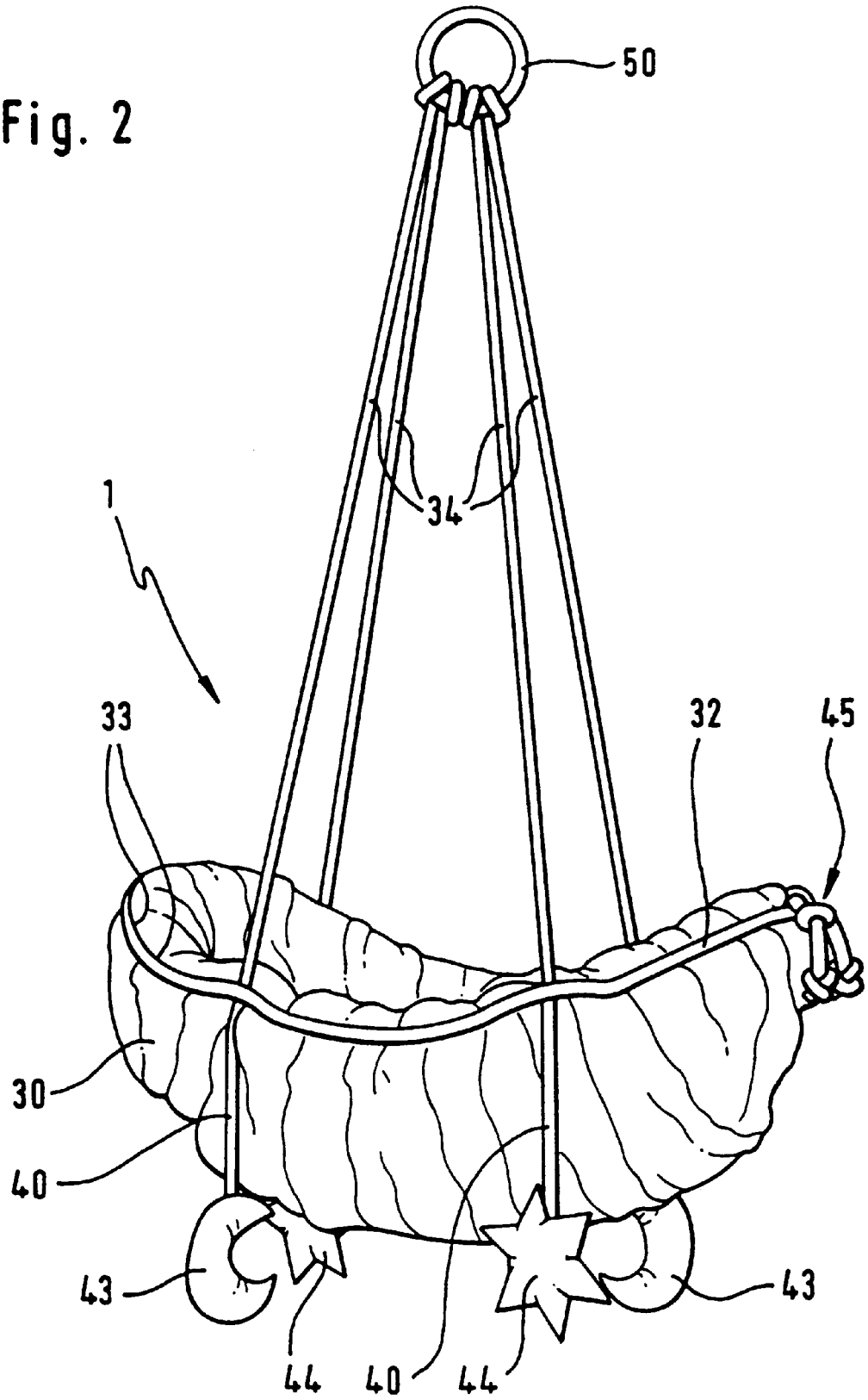
FIG. 2 is a first embodiment of a doll lounger.

FIG. 2 shows a first embodiment of a doll lounger 1. Said doll lounger 1 is attached to a holding ring 50 by means of four cords 34 that are partially affixed to each long side of the lounger. Suspension cords 34 may be connected to a cord in the form of a finished edge. The circular cord 32 terminates at one of the ends in a decorative knot 45. Said cord 32 is sewn to outer covering 30. Also connected to the cord seam is the outer covering and inner lining, not visible in FIG. 2. The materials for outer covering 30 and the inner lining are selected such that the inner lining is made of a bright color that is visible through the transparent material of outer covering 30. Both coverings cover the inside and outside of the entire basic body. Outer covering 30 is folded and gathered to fit around the basic body. The folds are fastened in the seam of cord 32, as indicated in FIG. 2 at points 33. Suspension cords 34 are provided with extensions 40 that extend downwardly from circular cord 32. Attached to the cord extensions are decorative elements in the form of moons 43 and stars 44 made of fabric.

Figure 3:
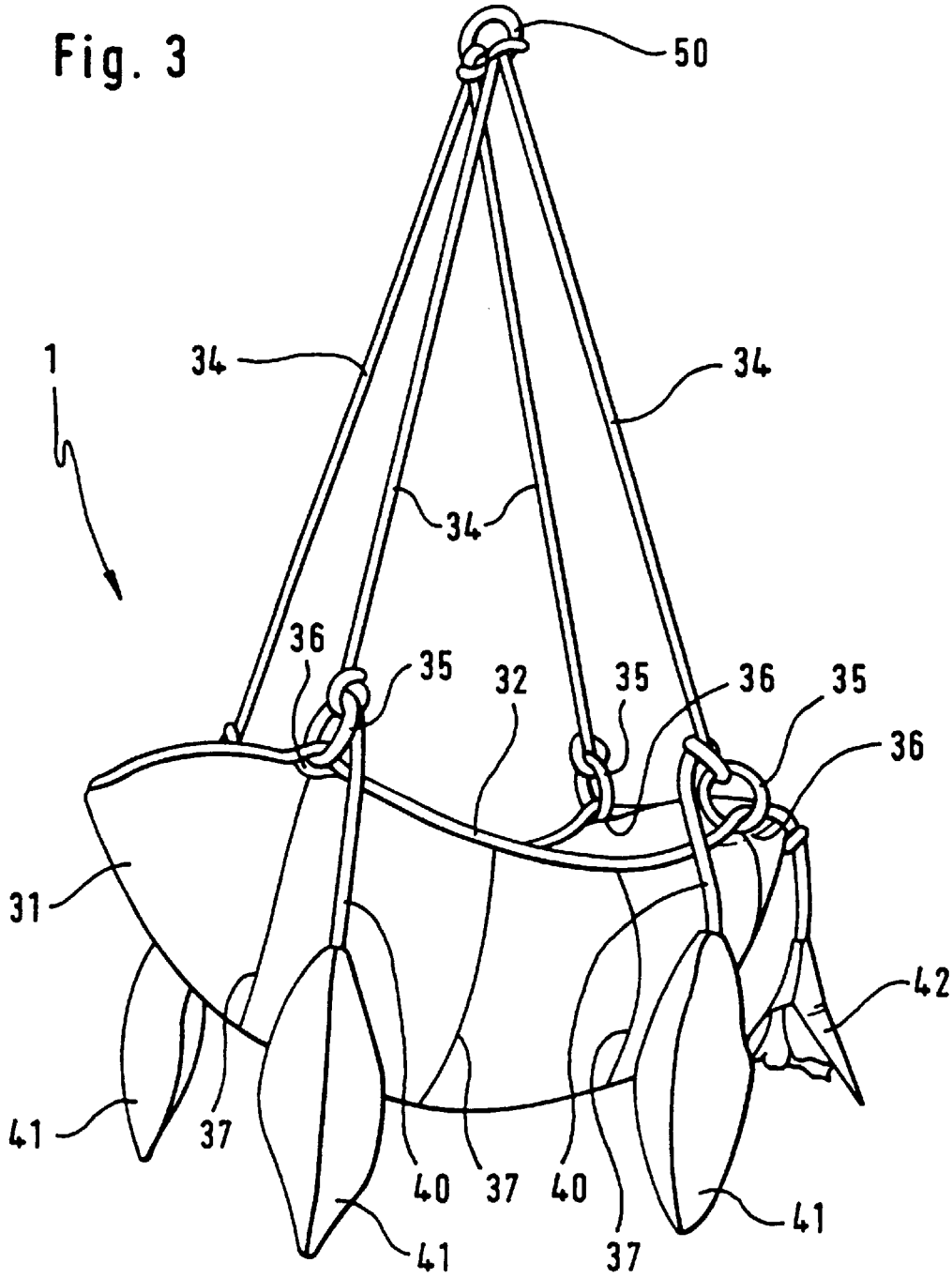
FIG. 3 is a second embodiment of a doll lounger.

FIG. 3 shows a second embodiment of the doll lounger 1. Similar elements are marked by the same reference numerals as in FIG. 2. Doll lounger 1 has only one outer covering 31. Said outer covering is tailored to fit the shape of the basic body (see also seams 37), and it covers both the outer and inner surfaces of said basic body. A circular cord 32 is sewn to outer covering 31 along the periphery of the rim of the basic body. At four points, cord 32 and outer covering 31 form a loop 36, in each of which a ring 35 is affixed. A suspension cord 34 is knotted to each ring 35. In this second embodiment decorative elements in the form of leaves 41 are attached to extensions 40 of suspension cords 34. The circular cord 32 terminates at one end of the lounger 1 in the form of a flower 42.

For both the first and second embodiments of the doll lounger 1, a basic body made of polyurethane foam plastic was used, as illustrated in FIGS. 1*a* and 1*b*.

Figure 4:
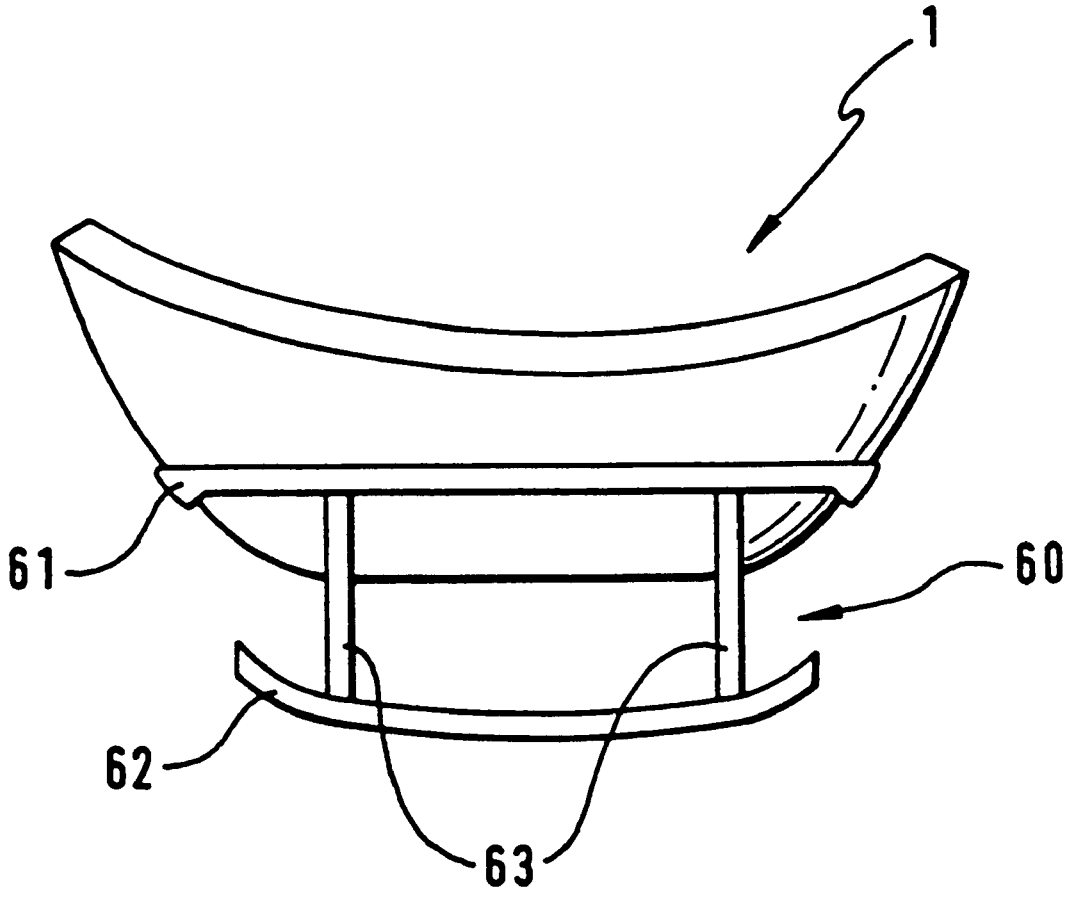
FIG. 4 is a doll lounger with an understructure.

FIG. 4 shows a doll lounger 1 with an understructure 60. Understructure 60 consists of a frame 61. Frame 61 is oval-shaped and has dimensions that conform to the external dimensions of the basic body of doll lounger 1. Attached to frame 61 are four legs 63, each pair 63 of which are provided with longitudinally-oriented rocker members. Doll lounger 1 is set in the frame 61 of understructure 60 and may be used as a doll cradle.

Figure 5:
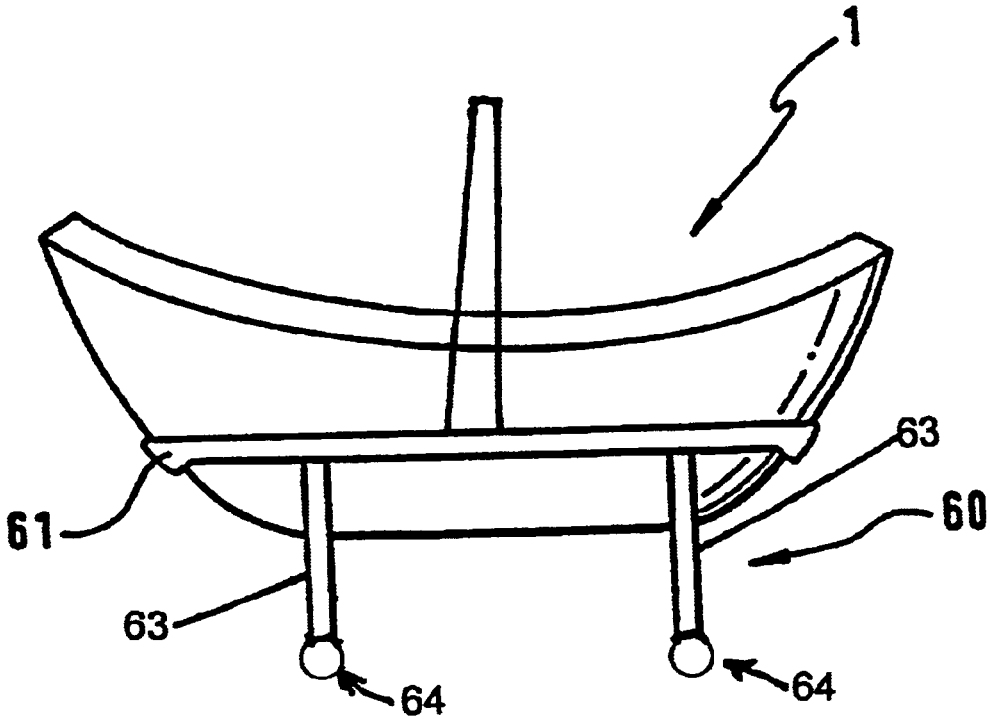
FIG. 5 is a doll lounger with an understructure including wheels and a handle.

Instead of mounting rocker members in a longitudinal direction, it is also possible to mount them transversely. An understructure consisting solely of frame and legs could also be used to convert the doll lounger into a doll bed. A further variation consists in mounting wheels 64 to the legs and attaching a handle 65 to the frame to allow the lounger to be used as a doll pram as shown in FIG. 5.

What is claimed is:

1. A doll lounger comprising a shell-shaped basic body of substantially stable design and made of a soft foam material, a casing, and means for correctly positioning the lounger, wherein the shell-shaped basic body is shaped approximately like a semi-ellipsoid or an oblong walnut shell-half, with an underside rounded off in all directions and an elliptical-shaped rim with two extending long sides and two rounded end sections.

2. A doll lounger according to claim 1, wherein the rim is formed with an upswing such that the long sides slope in the direction of at least one of the end sections.

3. A doll lounger according to claim 1, characterized in that the side walls of the basic body end at the elliptical-shaped rim as substantially flat surfaces, in an obliquely upward and outward orientation.

4. A doll lounger according to claim 3, wherein the end surfaces of the side walls which form the elliptical-shaped rim of the basic body extend approximately perpendicular to the surface of said walls and thus are angled outwardly and downward from the center of the basic body.

5. A doll lounger according to claim 1, wherein the basic body is foam-molded.

6. A doll lounger according to claim 1, wherein the basic body is made of a soft polyurethane foam.

7. A doll lounger according to claim 1, wherein the wall thickness of the basic body is selected so that, at a given soft-foam density, the body has sufficient form stability commensurate with the intended use of the lounger.

8. A doll lounger according to claim 7, wherein the walls of the basic body have a thickness in a range of 20 to 40 mm.

9. A doll lounger according to claim 1, wherein the long axis of the elliptical rim measures 300 to 500 mm and the short axis 200 to 300 mm, in each case as measured to the outer edge of the rim of the basic body.

10. A doll lounger according to claim 9, wherein overall height of the basic body is 150 to 220 mm.

11. A doll lounger according to claim 1, wherein the casing is a covering that encases at least part of the basic body.

12. A doll lounger according to claim 11, wherein the covering is made of a textile fabric or fleece.

13. A doll lounger according to claim 11, wherein the covering consists of at least an outer covering which conforms substantially to the convex outer surface of the basic body and which extends on the outside to the elliptical rim of the basic body.

14. A doll lounger according to claim 13, wherein the outer covering has a finished edge, in particular in the form of a cord or a strip, along the rim of the basic body.

15. A doll lounger according to claim 13, further comprising an additional base cover which lines the basic body to at least proximate the rim of its inner surface.

16. A doll lounger according to claim 15, wherein the base cover extends only over the inner surface of the basic body, and is connected or connectable along its edge section to the outer covering or to the finished edge thereof.

17. A doll lounger according to claim 15, wherein the base cover extends over the entire inner surface and outer surface of the basic body and that the outer covering is designed as a second, decorative covering.

18. A doll lounger according to claim 16, wherein the outer covering and an inner lining are made of different fabric materials.

19. A doll lounger according to claim 13, wherein the outer coverings are conformed by textile processing means to the shape of the basic body, and are provided with a suitable surface design.

20. A doll lounger according to claim 1, wherein the means for correctly positioning the doll lounger are the means for suspending the same.

21. A doll lounger according to claim 20, wherein the suspension means consist in particular of four suspension lines.

22. A doll lounger according to claim 21, wherein the suspension lines are textile cords or strips.

23. A doll lounger according to claim 21, wherein the suspension lines are mounted or are mountable at spaced intervals along the rim of the lounger.

24. A doll lounger according to claim 23, wherein the suspension lines are connected or are connectable to the rim or the finished edge of the outer covering.

25. A doll lounger according to claim 24, wherein the finished edge of the outer covering has means through which the suspension lines in the form of cords or strips are passed for knotting to themselves.

26. A doll lounger according to claim 24, wherein the suspension lines have means for hooking into corresponding means on the finished edge of the outer covering.

27. A doll lounger according to claim 14, wherein a finished edge in the form of a cord can be passed through loops provided on the outer covering.

28. A doll lounger according to claim 14, wherein means are provided on the finished edge for mounting at least one of decorative objects and doll toys.

29. A doll lounger according to claim 28, wherein said mounting means consist of extensions or suspension lines.

30. A doll lounger according to claim 1, wherein a separate understructure is provided as a supplemental means for correctly positioning said lounger.

31. A doll lounger according to claim 30, wherein said understructure has an elliptical-shaped frame conforming to the mean circumference of the basic body, in which the lounger may be placed in substantial line contact therewith.

32. A doll lounger according to claim 30, wherein said understructure is provided with rocker members.

33. A doll lounger according to claim 30, wherein the understructure is designed in the shape of a doll pram and is mounted on wheels.

34. A doll lounger according to claim 19 wherein there are two outer coverings conformed by textile processing means.

35. A doll lounger according to claim 19 wherein the textile processing means comprises fixing of folds.

* * * * *